US006913417B2

(12) United States Patent
Lind et al.

(10) Patent No.: US 6,913,417 B2
(45) Date of Patent: Jul. 5, 2005

(54) LINE STRIPER SENSOR AND DISPLAY SYSTEM

(75) Inventors: Robert J. Lind, Robbinsdale, MN (US); Christopher A. Lins, Milaca, MN (US); Jon M. Knutson, Maple Grove, MN (US); Michael J. Mansheim, Burnsville, MN (US); Russel R. Paul, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 10/498,209

(22) PCT Filed: Jan. 14, 2003

(86) PCT No.: PCT/US03/01031

§ 371 (c)(1),
(2), (4) Date: Jun. 9, 2004

(87) PCT Pub. No.: WO03/060430

PCT Pub. Date: Jul. 24, 2003

(65) Prior Publication Data

US 2005/0072858 A1 Apr. 7, 2005

Related U.S. Application Data

(60) Provisional application No. 60/349,148, filed on Jan. 15, 2002.

(51) Int. Cl.[7] ..... E01C 23/16
(52) U.S. Cl. ..... 404/93; 404/84.05
(58) Field of Search ..... 404/83, 84.05, 404/93; 388/907.5, 909

(56) References Cited

U.S. PATENT DOCUMENTS

| | | | | | |
|---|---|---|---|---|---|
| 5,203,923 | A | * | 4/1993 | Hartman | 118/659 |
| 5,263,789 | A | * | 11/1993 | Torntore et al. | 404/93 |
| 5,540,518 | A | * | 7/1996 | Wambold | 404/84.05 |
| 5,599,133 | A | * | 2/1997 | Costello et al. | 404/72 |
| 6,413,012 | B1 | * | 7/2002 | Jones | 404/94 |
| 6,547,158 | B1 | * | 4/2003 | Smith | 239/150 |

* cited by examiner

*Primary Examiner*—Bentsu Ro
(74) *Attorney, Agent, or Firm*—Douglas B. Farrow

(57) ABSTRACT

Sensors (18, 20 and 22) and an interactive display (12) are added to an airless gas powered line striping machine (10) to provide the operator with a variety of information about the operating parameters. In addition to the pressure sensor/transducer (14) required to control the pressure through a clutch, the system includes a sensor (reed switch in the preferred embodiment) (18) to count pump strokes or drive revolutions, a sensor (22) to monitor when the gun trigger is activated and a sensor (26) to monitor wheel rotation (hall effect sensor detecting pulses from gear mounted on wheel in the preferred embodiment). A digital display (12) is included to read out measured and calculated values.

2 Claims, 1 Drawing Sheet

LINE STRIPER SENSOR AND DISPLAY SYSTEM

TECHNICAL FIELD

This application is a 371 of PCT/US03/01031 Jan. 14, 2003 which claims the benefit of U.S. Provisional Application Ser. No. 60/349,148, filed Jan. 15, 2002.

BACKGROUND ART

While various airless line stripers are well known, use of many such models has required substantial calculation and activity on the part of the operator in order to obtain useable information.

DISCLOSURE OF THE INVENTION

Sensors and an interactive display are added to an airless gas powered line striping machine to provide the operator with a variety of information about the operating parameters. In addition to the pressure sensor/transducer required to control the pressure through a clutch, the system includes a sensor (reed switch in the preferred embodiment) to count pump strokes or drive revolutions, a sensor to monitor when the gun trigger is activated and a sensor to monitor wheel rotation (hall effect sensor detecting pulses from gear mounted on wheel in the preferred embodiment).

A digital display is included to read out measured and calculated values. The push button on the display allows the operator to select different display modes and to provide input to the system such as units of measure, line width, reset job data (ft, gallons) to zero and activate features.

This set of sensors and gas engine coil power combined with the operator input for line width allow the microprocessor based control to calculate and display a wide variety of information including, system pressure, machine speed, distance traveled with or without spraying (line length and total travel), volume of material sprayed (at spraying pressure or total), wet film build (running average or accumulative average), engine rpm, clutch cycles, engine hours, clutch hours, shut-off timer for flushing, flow rate information and number of gun triggers With this information available, striping operators can set up their machine to consistent settings and monitor outputs while operating to achieve desired results. Striping operators can also use the system to measure and bid jobs. In addition, the information can be used for maintenance schedules.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
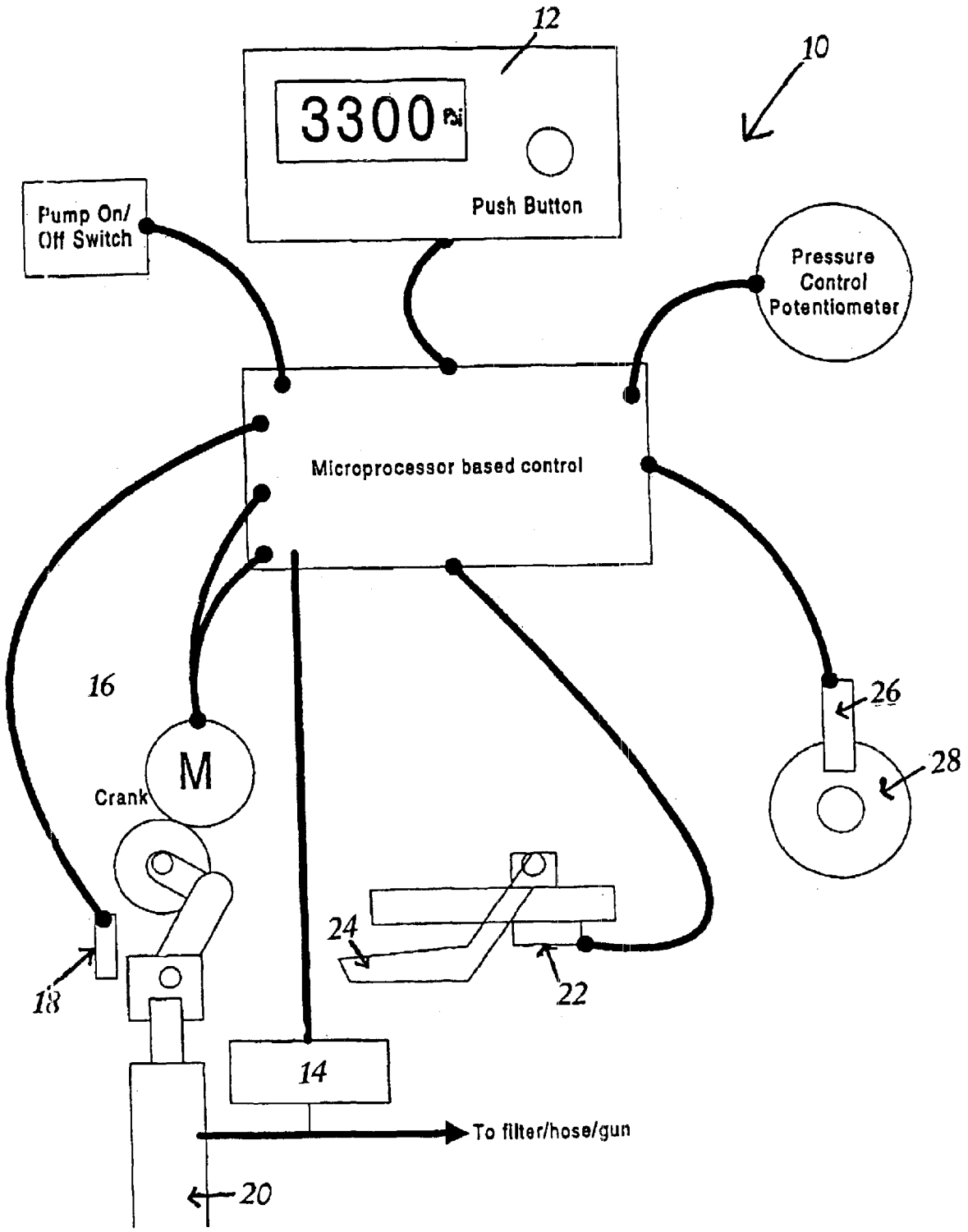
FIG. 1 shows a schematic diagram of the instant invention.

Sensors and an interactive display 12 are added to an airless gas powered line striping machine 10 to provide the operator with a variety of information about the operating parameters. In addition to the pressure sensor/transducer 14 required to control the pressure through a clutch 16, the system includes a sensor 18 (a reed switch in the preferred embodiment) to count pump 20 strokes or drive revolutions, a sensor 22 to monitor when the gun trigger 24 is activated and a sensor 26 to monitor wheel 28 rotation (hall effect sensor detecting pulses from gear mounted on wheel in the preferred embodiment).

A digital display 12 is included to read out measured and calculated values. The push button on the display allows the operator to select different display modes and to provide input to the system such as units of measure, line width, reset job data (ft, gallons) to zero and activate features.

This set of sensors and gas engine coil power combined with the operator input for line width allow the microprocessor based control to calculate and display a wide variety of information including, system pressure, machine speed, distance traveled with or without spraying (line length and total travel), volume of material sprayed (at spraying pressure or total), wet film build (running average or accumulative average), engine rpm, clutch cycles, engine hours, clutch hours, shut-off timer for flushing, flow rate information and number of gun triggers With this information available, striping operators can set up their machine to consistent settings and monitor outputs while operating to achieve desired results. Striping operators can also use the system to measure and bid jobs. In addition, the information can be used for maintenance schedules.

It is contemplated that various changes and modifications may be made to the sensor and display system without departing from the spirit and scope of the invention as defined by the following claims.

What is claimed is:

1. A control system for an airless line striping machine having a pump, rotating wheels and a gun trigger, said system comprising:

a pump sensor for counting pump strokes or drive revolutions;

a gun trigger sensor to monitor when the gun trigger is activated;

a wheel rotation sensor to monitor wheel rotation; and an interactive display to provide the operator with a variety of information about the operating parameters.

2. The control system of claim 1 wherein said airless line striping machine is powered by a gasoline engine having coil power which provides power to said control system.

* * * * *